US011612287B2

(12) United States Patent
Harting

(10) Patent No.: US 11,612,287 B2
(45) Date of Patent: Mar. 28, 2023

(54) SIDE BRUSHES FOR A ROBOTIC VACUUM CLEANER

(71) Applicant: SHARKNINJA OPERATING LLC, Needham, MA (US)

(72) Inventor: David Harting, Mansfield, MA (US)

(73) Assignee: SharkNinja Operating LLC, Needham, MA (US)

( * ) Notice: Subject to any disclaimer, the term of this patent is extended or adjusted under 35 U.S.C. 154(b) by 280 days.

(21) Appl. No.: 16/938,386

(22) Filed: Jul. 24, 2020

(65) Prior Publication Data

US 2021/0022574 A1 Jan. 28, 2021

Related U.S. Application Data

(60) Provisional application No. 62/946,152, filed on Dec. 10, 2019, provisional application No. 62/879,360, filed on Jul. 26, 2019.

(51) Int. Cl.
*A47L 9/04* (2006.01)

(52) U.S. Cl.
CPC ..... *A47L 9/0488* (2013.01); *A47L 9/0411* (2013.01); *A47L 9/0466* (2013.01); *A47L 2201/00* (2013.01)

(58) Field of Classification Search
CPC .... A47L 9/0488; A47L 9/0411; A47L 9/0466; A47L 2201/00
See application file for complete search history.

(56) References Cited

U.S. PATENT DOCUMENTS

| | | | |
|---|---|---|---|
| 9,414,729 | B2 | 8/2016 | Zydek |
| 2005/0166356 | A1 | 8/2005 | Uehigashi |
| 2009/0314318 | A1 | 12/2009 | Chang |
| 2012/0011668 | A1 | 1/2012 | Schnittman et al. |
| 2015/0342431 | A1 | 12/2015 | Zydek |
| 2017/0079499 | A1 | 3/2017 | Schnittman et al. |
| 2017/0181593 | A1 | 6/2017 | Ichikawa et al. |
| 2020/0113397 | A1 | 4/2020 | Schwering et al. |

FOREIGN PATENT DOCUMENTS

| | | | |
|---|---|---|---|
| CN | 106473675 | | 3/2017 |
| CN | 107581978 | A | 1/2018 |
| DE | 9403678 | U1 | 5/1994 |
| JP | 3486923 | B2 | 1/2004 |
| JP | 2013198704 | A | 10/2013 |
| KR | 20070066146 | A | 6/2007 |
| WO | 2020011568 | A1 | 1/2020 |
| WO | 2020148136 | A1 | 7/2020 |

OTHER PUBLICATIONS

PCT Search Report and Written Opinion, dated Oct. 8, 2020, received in corresponding PCT Application No. PCT/US20/43492, 10 pages.

*Primary Examiner* — David Redding
(74) *Attorney, Agent, or Firm* — Grossman Tucker Perreault & Pfleger, PLLC

(57) ABSTRACT

A robotic cleaner may include an air inlet, a suction motor, the suction motor being fluidly coupled to the air inlet, and a first primary side brush configured to rotate about a first primary side brush rotation axis. The first primary side brush rotation axis may extend transverse to a surface to be cleaned at a first non-perpendicular angle.

20 Claims, 9 Drawing Sheets

SIDE BRUSHES FOR A ROBOTIC VACUUM CLEANER

CROSS-REFERENCE TO RELATED APPLICATIONS

The present application claims the benefit of U.S. Provisional Application Ser. No. 62/879,360 filed on Jul. 26, 2019, entitled Side Brushes for a Robotic Vacuum Cleaner and U.S. Provisional Application Ser. No. 62/946,152 filed on Dec. 10, 2019, entitled Side Brushes for a Robotic Vacuum Cleaner, each of which are fully incorporated herein by reference.

TECHNICAL FIELD

The present disclosure is generally directed to surface treatment apparatuses and more specifically to a robotic cleaner.

BACKGROUND INFORMATION

Surface treatment apparatuses can include robotic cleaners. A robotic cleaner is configured to autonomously travel about a surface while collecting debris left on the surface. A robotic cleaner can be configured to travel along a surface according to a random and/or predetermined path. When traveling along a surface according to the random path, the robotic cleaner may adjust its travel path in response to encountering one or more obstacles. When traveling along a surface according to a predetermined path, the robotic cleaner may have, in prior operations, developed a map of the area to be cleaned and travel about the area according to a predetermined path based on the map. Regardless of whether the robotic cleaner is configured to travel according to a random or predetermined path, the robotic cleaner may be configured to travel in predetermined patterns. For example, a robotic cleaner may be positioned in a location of increased debris and be caused to enter a cleaning pattern that causes the robotic cleaner to remain in the location of increased debris for a predetermined time.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a robotic cleaner (e.g., a robotic vacuum cleaner). The robotic cleaner may include a suction motor configured to generate suction at an air inlet of the robotic cleaner and at least one side brush to urge debris on a surface to be cleaned towards the air inlet. The at least one side brush rotates about a rotation axis that extends transverse to the surface to be cleaned at a non-perpendicular angle. An angled rotation axis may result in the side brush having inconsistent engagement with the surface to be cleaned.

Figure 1:
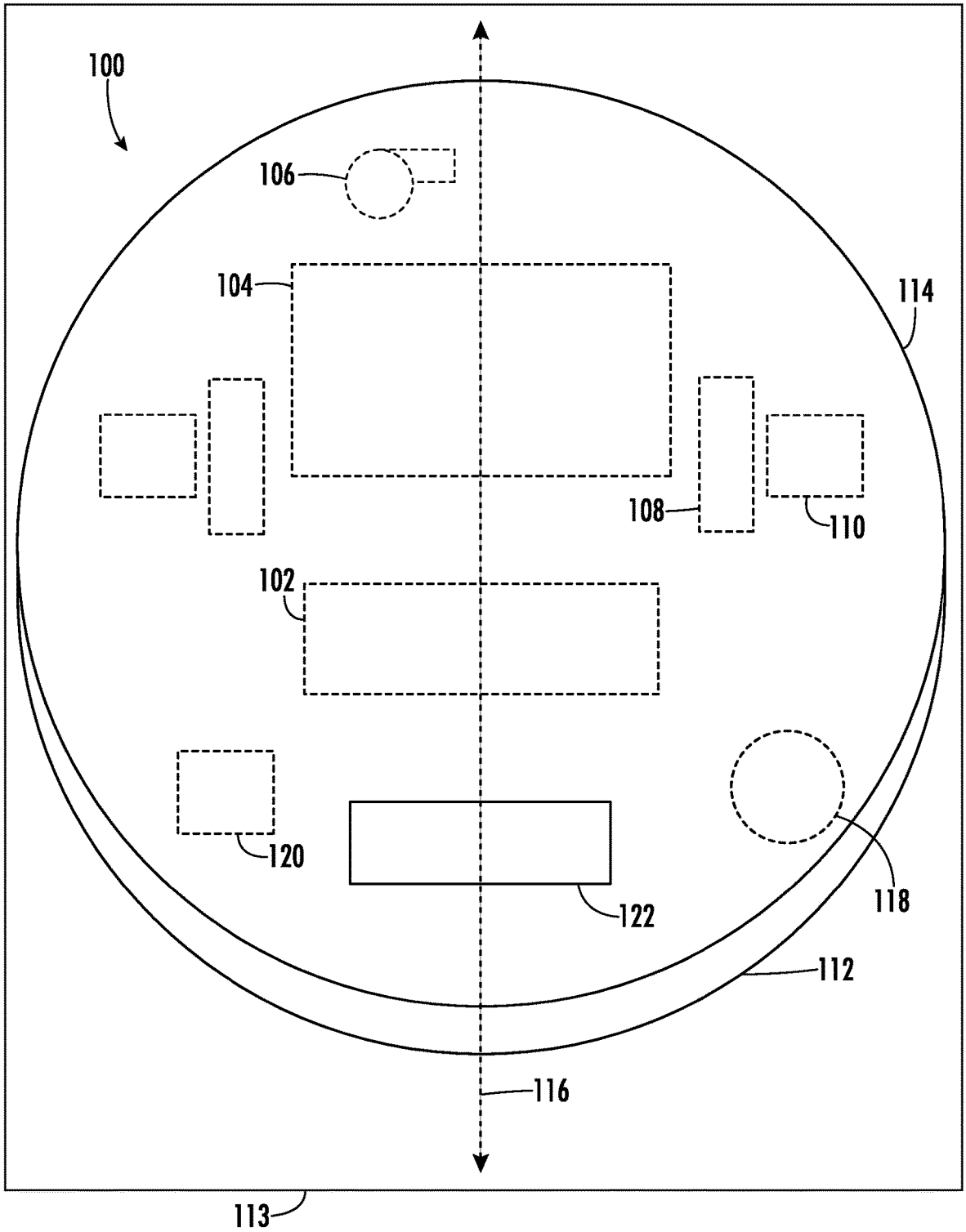
FIG. 1 is a schematic view of an example of a robotic vacuum cleaner, consistent with embodiments of the present disclosure.

FIG. 1 shows a schematic view of an example of a robotic cleaner 100 (e.g., a robotic vacuum cleaner). As shown, the robotic cleaner 100 includes an air inlet 102, a dust cup 104, and a suction motor 106. The suction motor 106 and the dust cup 104 are fluidly coupled to the air inlet 102. The suction motor 106 causes debris to be suctioned into the air inlet 102 and deposited into the dust cup 104 for later disposal.

As also shown, the robotic cleaner 100 includes a plurality of wheels 108 coupled to a respective drive motor 110. As such, each wheel 108 may generally be described as being independently driven. The robotic cleaner 100 can be steered by adjusting the rotational speed of one of the plurality of wheels 108 relative to the other of the plurality of wheels 108.

A displaceable bumper 112 can be disposed along a portion of a perimeter of a housing 114 of the robotic cleaner 100. The displaceable bumper 112 is configured to transition between an unactuated position and an actuated position in response to engaging, for example, an obstacle. The displaceable bumper 112 can be configured to be moveable along a first axis 116 extending generally parallel to a top surface of the housing 114. As such, the displaceable bumper 112 is displaced in response to engaging (e.g., contacting) at least a portion of an obstacle disposed on and extending from a surface to be cleaned 113 (e.g., a forward obstacle). Additionally, or alternatively, the displaceable bumper 112 can be configured to be moveable along a second axis that extends transverse to (e.g., perpendicular to) the first axis 116. As such, the displaceable bumper 112 is displaced in response to engaging (e.g., contacting) at least a portion of an obstacle that is spaced apart from the surface to be cleaned 113 (e.g., an overhanging obstacle). Therefore, the robotic cleaner 100 may avoid becoming trapped between the obstacle and the surface to be cleaned 113. The robotic cleaner 100 can be configured to determine along which axis the displaceable bumper 112 is displaced. Such a configuration may allow the robotic cleaner 100 to carry out different obstacle detection behaviors based, at least in part, on the location of the obstacle relative to the robotic cleaner 100. As such, the robotic cleaner 100 can have different behaviors based on whether the detected obstacle is an overhanging obstacle or a forward obstacle.

One or more side brushes 118 can be positioned such that the side brush 118 rotates within the perimeter of the housing 114 of the robotic cleaner 100. In other words, the one or more side brushes 118 do not extend beyond a perimeter of the housing 114. Alternatively, the one or more side brushes 118 may extend beyond a perimeter of the housing 114.

The one or more side brushes 118 can be configured to urge debris in a direction of the air inlet 102. As such debris located beyond a travel path of the air inlet 102 can be collected. The one or more side brushes 118 can be configured to rotate in response to activation of at least one side brush motor 120. In some instances, each side brush 118 may be associated with a respective side brush motor 120. In other instances, at least two side brushes 118 may be associated with a common side brush motor 120 such that the common side brush motor 120 causes both side brushes 118 to rotate.

A user interface 122 can be provided to allow a user to control the robotic cleaner 100. For example, the user interface 122 may include one or more push buttons that correspond to one or more features of the robotic cleaner 100. Liquid ingress protection may be provided at the user interface 122 to prevent or otherwise mitigate the effects of a liquid being inadvertently spilled on the housing 114 of the robotic cleaner 100.

Figure 2A:
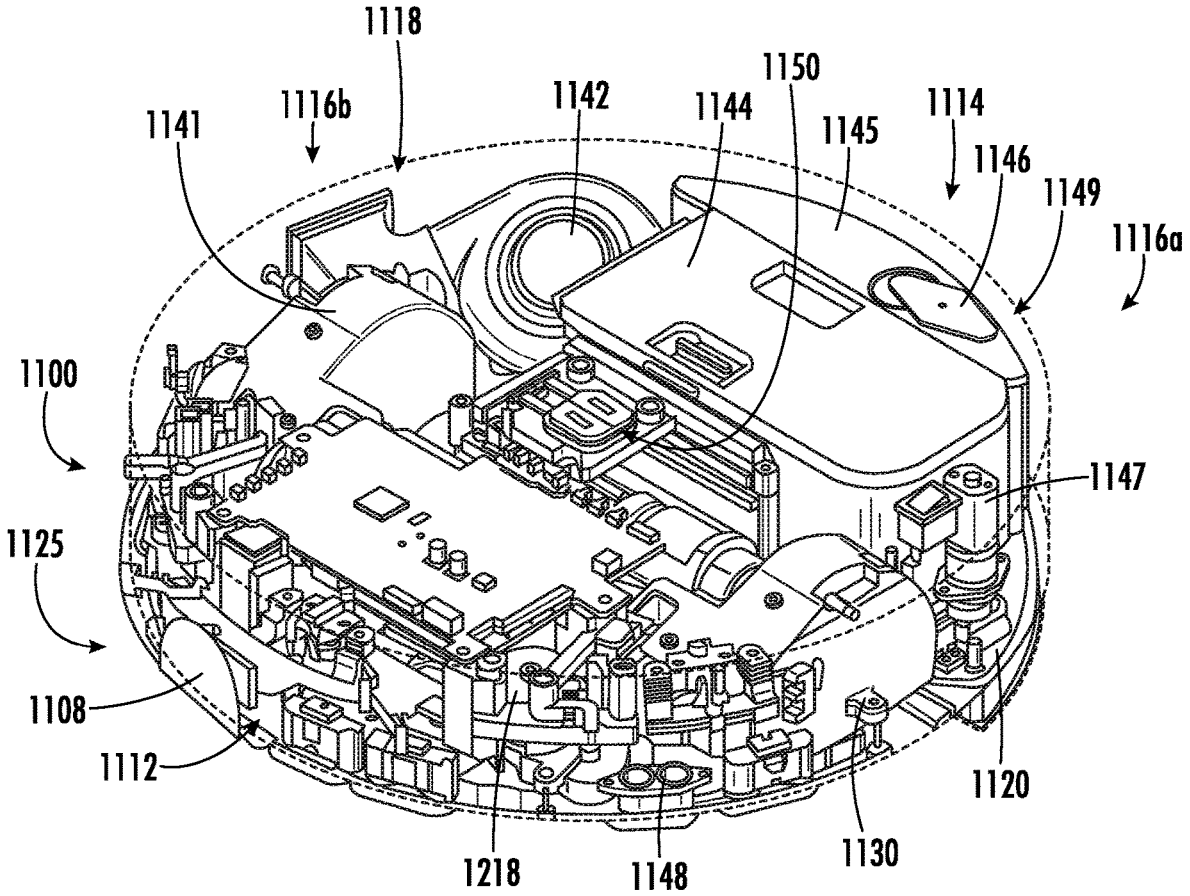
FIG. 2A is a perspective view of a robotic vacuum cleaner, consistent with embodiments of the present disclosure.
Figure 2B:
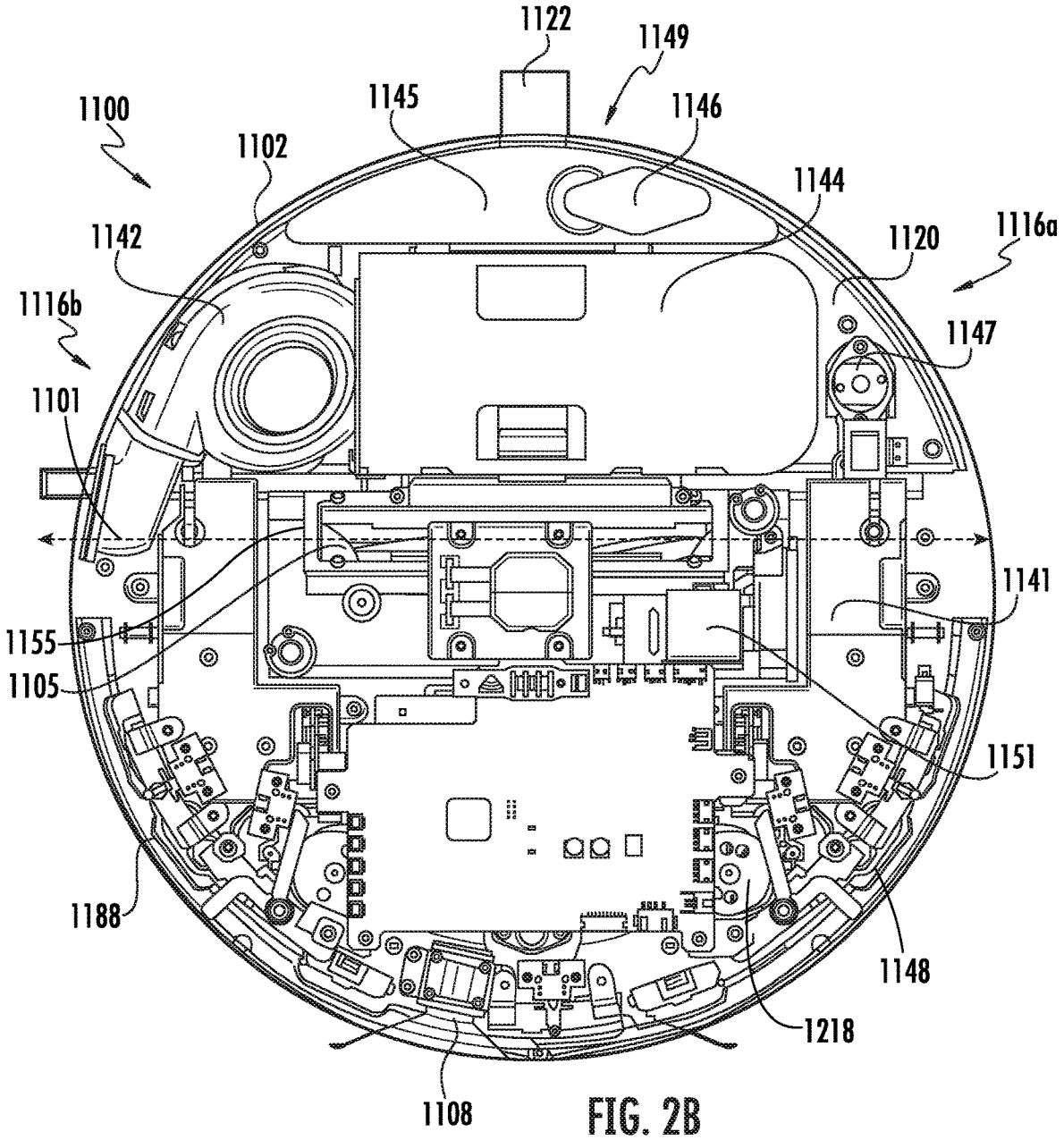
FIG. 2B is a top view of the robotic vacuum cleaner of FIG. 2A, consistent with embodiments of the present disclosure.

Referring to FIGS. 2A-2B, an embodiment of a robotic cleaner 1100, which may be an example of the robotic cleaner 100 of FIG. 1, is shown and described. Although a particular embodiment of a robotic cleaner is shown and described herein, the concepts of the present disclosure may apply to other types of robotic vacuum cleaners or robotic cleaners.

The robotic cleaner 1100 includes a housing or chassis 1102 with a front side 1112, and a back side 1114, left and right sides 1116*a*, 1116*b*, an upper side (or top surface) 1118, and a lower or under side (or bottom surface) 1125. A bumper (not shown) is movably coupled to the housing 1102 (e.g., such that the bumper extends along at least a portion of the forward portion of the housing 1102). The top of the housing 1102 may include controls (or a user interface) 1150 (e.g., buttons) to initiate certain operations, such as autonomous cleaning, spot cleaning, and docking, and indicators (e.g., light emitting diodes (LEDs)) to indicate operations, battery charge levels, errors, and/or any other information.

As shown, the robotic cleaner 1100 includes a suction conduit (or an air inlet) 1155 fluidly coupled to a dust cup 1144 and a suction motor 1142. The suction motor 1142 causes debris to be suctioned into the suction conduit 1155 and deposited into the dust cup 1144 for later disposal.

As also shown, the robotic cleaner 1100 includes a plurality of driven wheel assemblies 1141, each having a corresponding wheel 1130 coupled to a respective drive motor of the driven wheel assembly 1141. As such, each wheel 1130 may generally be described as being independently driven. The robotic cleaner 1100 can be steered by adjusting the rotational speed of one of the plurality of wheels 1130 relative to the other of the plurality of wheels 1130.

A displaceable bumper can be disposed along a portion of a perimeter defined by a housing 1102 of the robotic cleaner 1100. The displaceable bumper is configured to transition between an unactuated position and an actuated position in response to engaging, for example, an obstacle. The displaceable bumper can be configured to be moveable along a first axis extending generally parallel to a top surface of the housing 1102. As such, the displaceable bumper is displaced in response to engaging (e.g., contacting) at least a portion of an obstacle disposed on and extending from a surface to be cleaned. Additionally, or alternatively, the displaceable bumper can be configured to be moveable along a second axis that extends transverse to (e.g., perpendicular to) the first axis. As such, the displaceable bumper is displaced in response to engaging (e.g., contacting) at least a portion of an obstacle that is spaced apart from the surface to be cleaned. Therefore, the robotic cleaner 1100 may avoid becoming trapped between the obstacle and the surface to be cleaned.

A user interface 1150 can be provided to allow a user to control the robotic cleaner 1100. For example, the user interface 1150 may include one or more push buttons that correspond to one or more features of the robotic cleaner 1100. Liquid ingress protection may be provided at the user interface 1150 to prevent or otherwise mitigate the effects of a liquid being inadvertently spilled on the housing 1102 of the robotic cleaner 1100.

The robotic cleaner 1100 includes an agitator 1105 (e.g., a main brush roll) configured to be rotated. For example, the agitator 1105 may be coupled to a motor 1151, such as an AC or DC motor. The motor can be configured to impart rotation to the agitator 1105 by way of, for example, one or more drive belts, gears, and/or other driving mechanism. The agitator 1105 rotates about an agitator rotation axis 1101. The agitator rotation axis 1101 extends substantially (e.g., within 1°, 2°, 3°, 4°, or 5° of) parallel to a surface being cleaned. In other words, the agitator rotation axis 1101 may generally be described as extending substantially horizontally. Rotation of the agitator 1105 urges debris in a direction of the suction conduit 1155. The agitator 1105 can be at least partially disposed within the suction conduit 1155.

The agitator 1105 may have bristles, fabric, or other cleaning elements, or any combination thereof around the outside of the agitator 1105. The agitator 1105 may include, for example, strips of bristles in combination with strips of a rubber or elastomer material. The agitator 1105 may also be removable to allow the agitator 1105 to be cleaned more easily and allow the user to change the size of the agitator 1105, change type of bristles on the agitator 1105, and/or remove the agitator 1105 entirely depending on the intended application. The robotic cleaner 1100 may further include a bristle strip (not shown) on an underside of the housing 1102 and proximate to a portion of the suction conduit 1155. The bristle strip may include bristles having a length sufficient to at least partially contact the surface to be cleaned. The bristle strip may also be angled, for example, toward the suction conduit 1155.

The robotic cleaner may also include one or more side brush motors 1218 configured to cause one or more side brushes to rotate. Rotation of the one or more side brushes urges debris towards the agitator 1105. Such a configuration may allow debris that lies outside a travel path of the agitator 1105 and/or the suction conduit 1155 to be urged into the suction conduit 1155. The side brush motors 1218 may be configured to rotate the one or more side brushes about a side brush rotation axis that extends transverse to a surface being cleaned (e.g., at a non-perpendicular angle).

The robotic cleaner 1100 also includes several different types of sensors. For example, the robotic cleaner 1100 may include one or more forward obstacle sensors 1108 configured to detect obstacles in a travel path of the robotic cleaner 1100. The one or more forward obstacle sensors 1108 may be integrated with and/or separate from the bumper. For example, the one or more forward obstacle sensors 1108 may be configured to cooperate with the bumper such that signals emitted from the forward obstacle sensors 1108 can pass through at least a portion of the bumper. The one or more forward obstacle sensors 1108 may include one or more of infrared sensors, ultrasonic sensors, time-of-flight sensors, a camera (e.g., a stereo or monocular camera), and/or any other sensor.

By way of further example, the robotic cleaner 1100 may include one or more floor type detection sensors 1148, 1188. The floor type detection sensors 1148, 1188 may be used to detect one or more qualities (or changes in qualities) of a surface on which the robotic cleaner 1100 is traveling. The one or more floor type detection sensors 1148, 1188 may include acoustic sensors (e.g., in the ultrasonic range or in the audible range), an infra-red sensor, a camera sensor, and/or any other sensor capable of detecting a quality of a surface. The detected qualities may include, for example, whether the surface being traveled on is a soft surface (e.g., a carpet) or a hard surface (e.g., a tile or hardwood floor).

Data generated by the one or more floor type detection sensors 1148, 1188 can be used by a controller of the robotic cleaner 1100 to adjust a behavior of the robotic cleaner 1100. For example, the data can be used to adjust one or more of a movement behavior (e.g., avoid carpeted surfaces when wet cleaning), a cleaning behavior (e.g., suction power, agitator speed, or side brush speed), an escape behavior, and/or any other behavior. In some instances, the algorithms that control the robotic cleaner's 1100 behavior are selected based on the determination of the surface type by the floor type detection sensors 1148, 1188. In other embodiments, the algorithms that control the behavior of the robotic cleaner 1100 are selected based on the identification of a change in the surface type by the floor type detection sensors 1148, 1188.

The robotic cleaner 1100 includes a wet cleaning module 1149 removably affixed to the robotic cleaner chassis 1102. The wet cleaning module 1149 includes a cleaning fluid tank 1145 and a stopper for the cleaning fluid tank 1146. The cleaning fluid tank 1146 further includes a tank base 1120 which is connected to a wet cleaning module motor 1147. A wet cleaning pad 1122 is operatively connected to the tank base 1120 via a wet pad plate (not shown). As the robotic cleaner travels across a floor, the suction conduit 1155, which is fluidly coupled to the suction motor 1142, collects dry debris from the floor while the wet cleaning module 1149 applies a cleaning fluid onto the cleaning pad 1122 and uses the cleaning pad 1122 to scrub the floor. The wet cleaning module motor 1147 powers one or more pumps configured to apply the cleaning fluid onto the cleaning pad 1122 and to agitate the cleaning pad 1122 during cleaning.

Figure 3A:
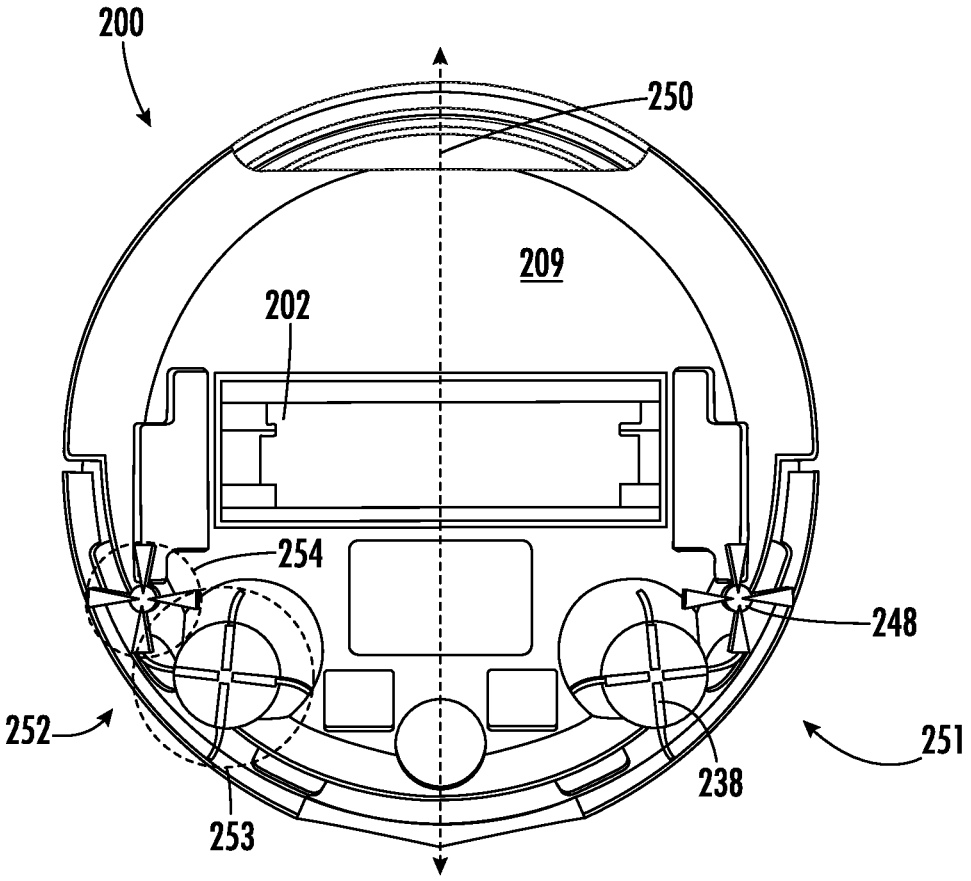
FIG. 3A is a bottom view of a robotic vacuum cleaner, consistent with embodiments of the present disclosure.

FIG. 3A shows a bottom view a robotic vacuum cleaner 200, which may be an example of the robotic vacuum cleaner of FIG. 1. As shown, the robotic vacuum cleaner 200 includes an air inlet 202 provided along a floor facing surface 209 of the robotic vacuum cleaner 200.

Figure 3B:
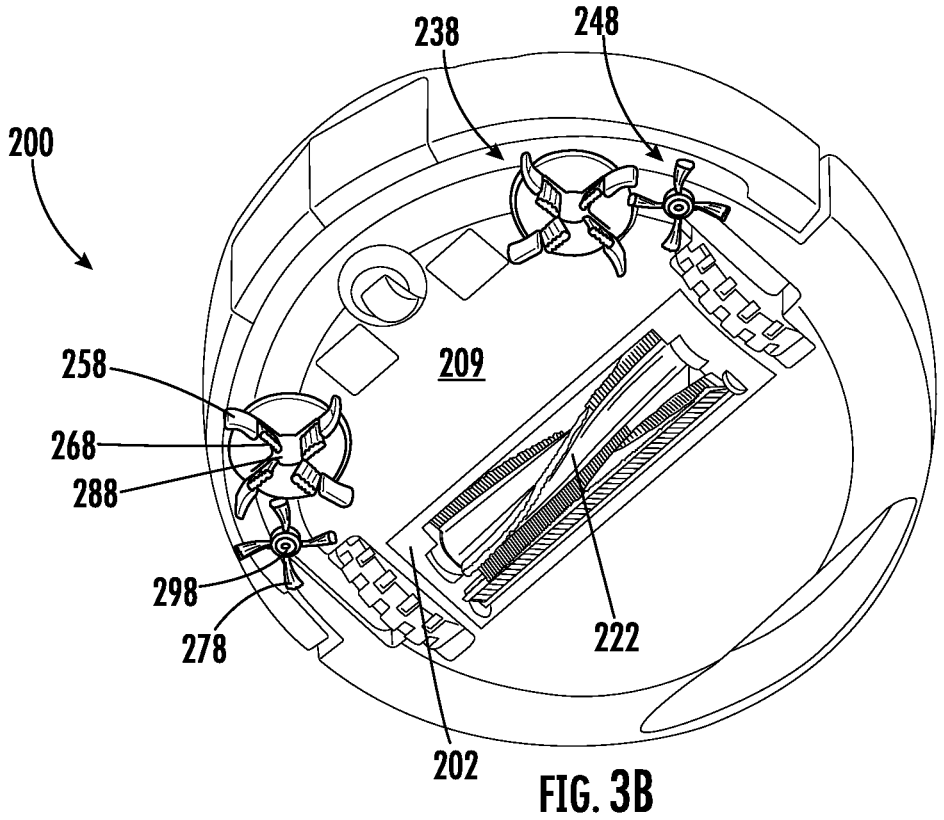
FIG. 3B is a bottom perspective view of the robotic vacuum cleaner of FIG. 3A, consistent with embodiments of the present disclosure.

As shown in FIG. 3B, an agitator 222 is provided within the air inlet 202 and configured to engage a surface (e.g., a floor). For example, the agitator 222 can be configured to rotate such that at least a portion of the agitator 222 contacts a floor and disturbs debris resting on or adhered to the floor such that the debris can be suctioned into the air inlet 202.

A plurality of side brushes 238, 248 can be configured to urge debris from a periphery of the robotic vacuum cleaner 200 in a direction of the air inlet 202. The plurality of side brushes 238, 248 may generally be described as increasing a total cleaning width of the robotic vacuum cleaner 200. For example, the plurality of side brushes 238, 248 can be configured to urge debris that lies outside a travel path of the air inlet 202 and/or the agitator 222 into the air inlet 202. In some instances, the plurality of side brushes 238, 248 do not extend past a periphery of the robotic vacuum cleaner 200.

The plurality of side brushes may include a primary side brush 238 and a secondary side brush 248. As shown, the secondary side brush 248 is positioned between the primary side brush 238 and the agitator 222. The primary side brush 238 may define a primary side brush swept area 253 and the secondary side brush 248 may define a secondary side brush swept area 254. In some instances, the primary side brush swept area 253 overlaps at least partially with the secondary side brush swept area 254. The swept area may generally be described as the area through which at least a portion of the corresponding side brush 238, 248 passes while rotating through a complete revolution (a rotation of 360°).

The primary side brush 238 and the secondary side brush 248 can be configured to cooperate to urge debris towards the air inlet 202. For example, the primary side brush 238 and the secondary side brush 248 may be counter rotating such that debris collected by the secondary side brush 248 is urged into the primary side brush 238.

The primary side brush 238 includes a hub 288 and at least one flexible protrusion 268 (or arm) extending from the hub 288. The at least one flexible protrusion 268 may include a blade 258. For example, the blade 258 may extend from a distal end of the flexible protrusion 268. A rigidity of the blade 258 may measure greater than a rigidity of the at least one flexible protrusion 268. For example, the at least one flexible protrusion 268 may be formed of a rubber and the blade 258 may be formed of a plastic. The blade 258 may have an arcuate (e.g., scoop) shape that is configured to urge debris towards the air inlet 202.

The blade 258 is configured to engage (e.g., contact) a surface to be cleaned. The at least one flexible protrusion 268 may be configured to be spaced apart from the surface to be cleaned such that the at least one flexible protrusion 268 does not engage with the surface to be cleaned. As such, a width of the blade 258 may measure greater than a width of the at least one flexible protrusion 268. In some instances, the flexible protrusion 268 is configured such that the blade 258 causes the flexible protrusion 268 to flex in response to changes in the surface to be cleaned. For example, when the robotic vacuum cleaner 200 traverses a threshold (e.g., a change in surface types) or a traversable obstacle, the flexible protrusion 268 may be caused to flex in response to the engagement between the blade 258 and the threshold or traversable obstacle. Such a configuration may encourage the blade 258 to maintain contact (e.g., consistent contact) with the surface to be cleaned.

The secondary side brush 248 includes a hub 298 having at least one flexible protrusion 278 extending therefrom. The flexible protrusion 278 may be formed by over molding a flexible material over the hub 298. The flexible protrusion 278 may include a plurality of bristles, a flexible wiper, or other structure positioned to engage with a surface to be cleaned. In some instances, the secondary side brush 248 may have the same structure as the primary side brush 238.

As shown, the robotic vacuum cleaner 200 may include a plurality of primary side brushes 238 and a plurality of secondary side brushes 248. The plurality of primary and secondary side brushes 238 and 248 may generally be described as being associated with a first brush group 251 or a second brush group 252, wherein the first brush group 251 includes at least one primary side brush 238 and at least one secondary side brush 248 and the second brush group 252 includes at least one primary side brush 238 and at least one secondary side brush 248. The first and second brush groups 251, 252 may be arranged on opposing sides of the robotic vacuum cleaner 200 (e.g., on opposing sides of a central axis 250 of the robotic vacuum cleaner 200, wherein the central axis 250 extends parallel to a forward direction of motion of the robotic vacuum cleaner 200).

Figure 4A:
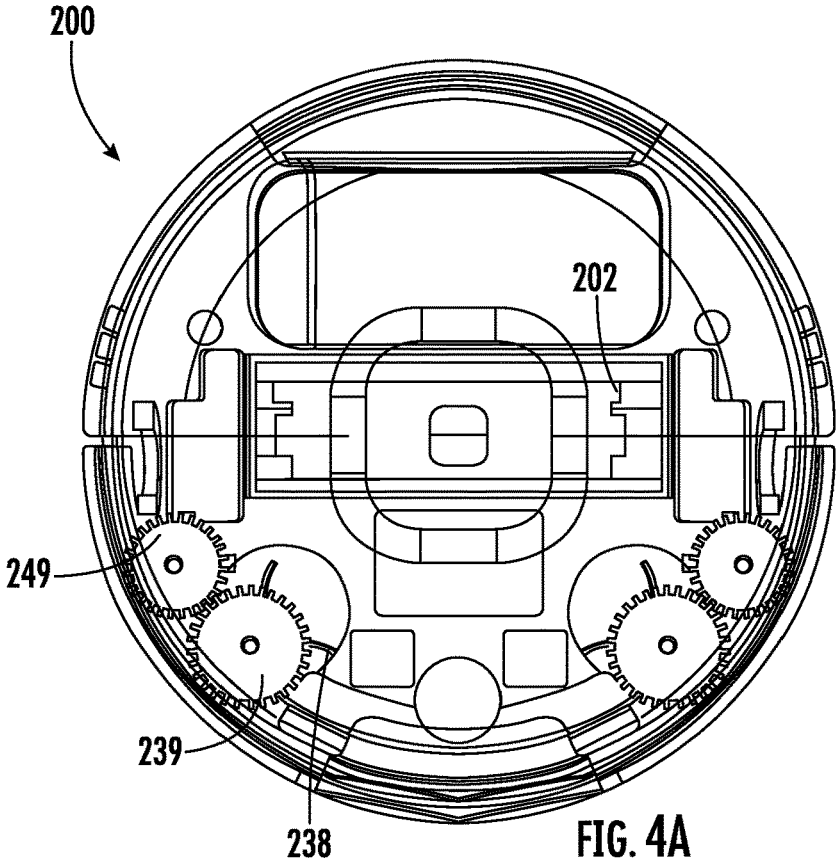
FIG. 4A is a top view of an example of the robotic vacuum cleaner of FIG. 3A, consistent with embodiments of the present disclosure.
Figure 4B:
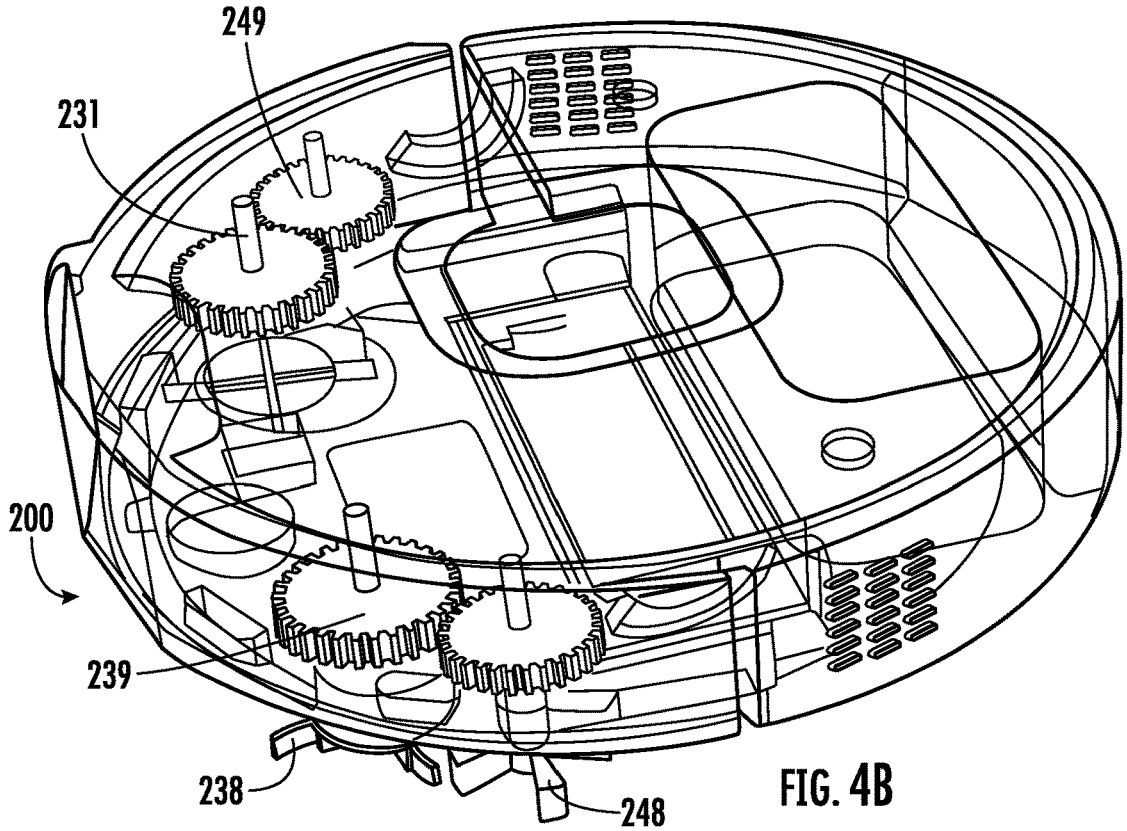
FIG. 4B is a side perspective view of the robotic vacuum cleaner of FIG. 4A, consistent with embodiments of the present disclosure.

FIGS. 4A-4B show a transparent view of the robotic vacuum cleaner 200. As shown, the robotic vacuum cleaner 200 includes a plurality of primary side brushes 238 and a plurality of secondary side brushes 248 arranged according to a first brush group and a second brush group, wherein each brush group includes at least one primary side brush 238 and at least one secondary side brush 248.

Each brush group can be driven by a respective side brush motor (not shown). For example, and as shown, each primary side brush 238 may be coupled to a driving gear 239 and a driven shaft 231 and each secondary side brush 248 may be coupled to a driven gear 249. The driving gear 239 is configured to engage with a corresponding driven gear 249 such that a rotation of the driven shaft 231 causes a corresponding rotation in both the primary side brush 238 and the secondary side brush 248 for a respective brush group. In other words, torque generated by the side brush motor is transferred from the side brush motor to the secondary side brush 238 through the driving gear 239 and the driven gear 249. The driven shaft 231 may be configured to couple to the primary side brush 238, the driving gear 239, and the side brush motor. As such, the primary side brush 238 and the secondary side brush 248 of a respective brush group may generally be described as being driven by a common side brush motor.

In the example shown, the primary side brush 238 and the secondary side brush 248, within a respective brush group, are counter rotating. However, the primary side brush 238 and the secondary side brush 248 within a respective brush group may be configured to be corotating (rotate according to the same direction). For example, the driving gear 239 may engage an intermediary gear and the intermediary gear may engage the driven gear 249. The driving gear 239 and the driven gear 249 can be configured such that the primary side brush 238 and the secondary side brush 248 rotate at the same or different speeds.

In some instances, a single side brush motor may cause both the primary side brush 238 and secondary side brush 248 for a corresponding brush group to rotate using one or more drive belts (e.g., a toothed belt). As such, torque generated by the side brush motor is transmitted from the driven shaft 231 to the secondary side brush 248 using a belt. In this instance, the primary side brush 238 and the secondary side brush 248 rotate in the same direction.

Figure 5A:
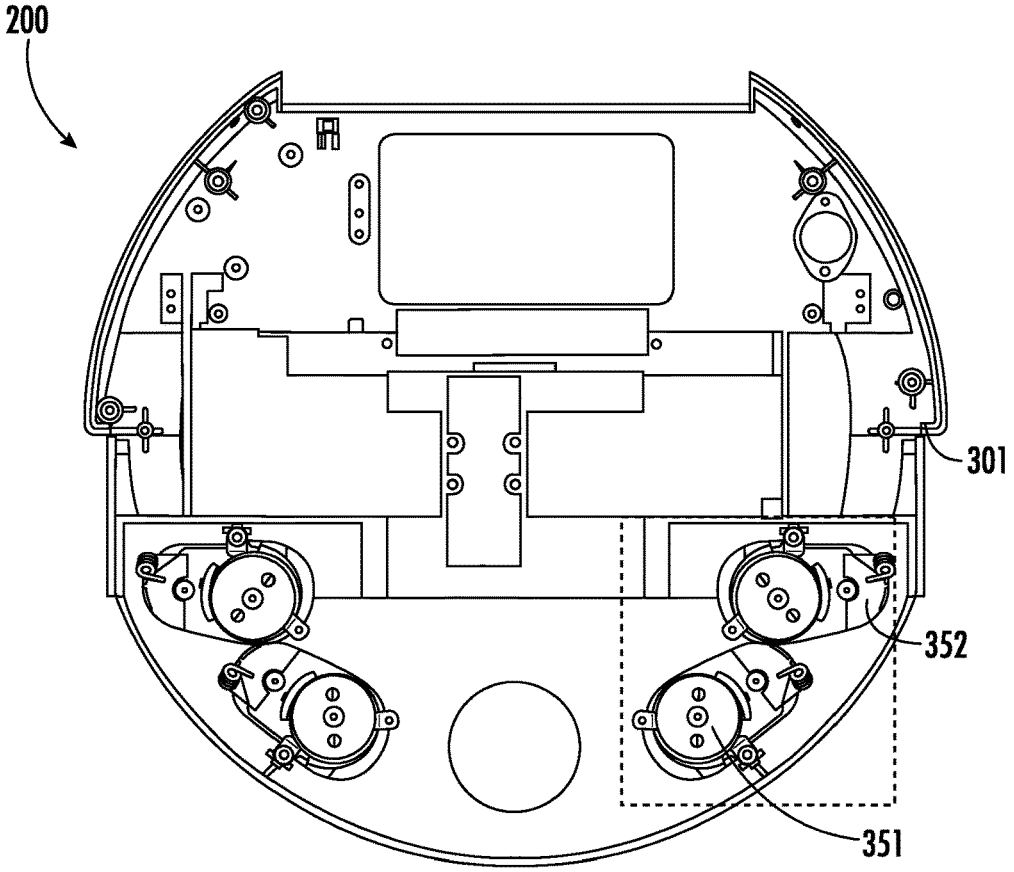
FIG. 5A is a top view of an example of the robotic vacuum cleaner of FIG. 3A having portions of the robotic cleaner removed therefrom for purposes of clarity, consistent with embodiments of the present disclosure.
Figure 5B:
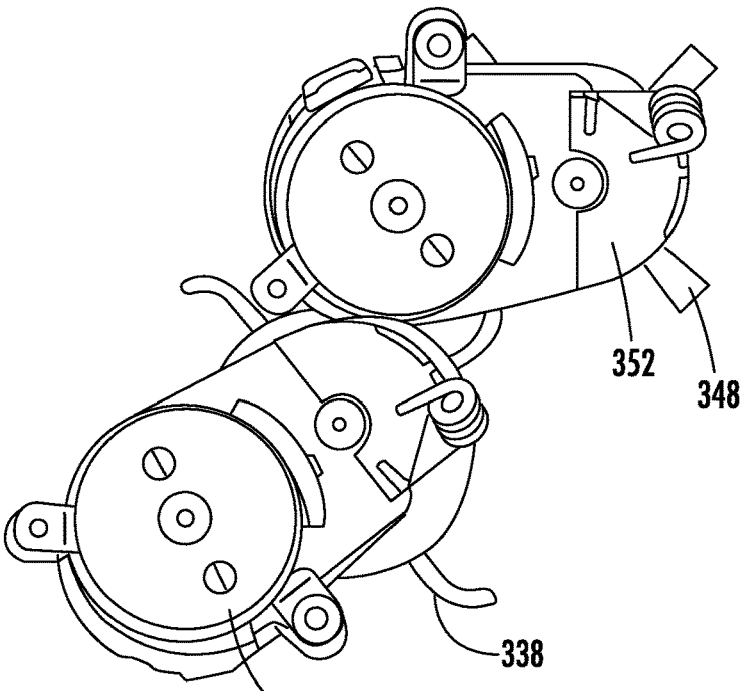
FIG. 5B is a top view of a side brush assembly of FIG. 5A, consistent with embodiments of the present disclosure.

FIG. 5A shows an example of a chassis 301 of the robotic vacuum cleaner 200 having side brush motors 351, 352 coupled thereto and FIG. 5B shows the first side brush motor 351 being coupled to a primary side brush 338 and the second side brush motor 352 being coupled to a secondary side brush 348. As such, each of the primary side brush 338 and the secondary side brush 348 are independently driven by a corresponding side brush motor 351, 352. As shown, the robotic vacuum cleaner 200 includes a plurality of primary side brushes 338 and a plurality of secondary side brushes 348 arranged according to a first brush group and a second brush group. Each brush group includes at least one primary side brush 338 and at least one secondary side brush 348. The first and second brush groups can be arranged on opposing sides of the robotic vacuum cleaner 200.

The first and second side brush motors 351, 352 can be configured such that the primary side brush 338 and the secondary side brush 348 for a respective brush group are corotating or counter rotating. The first and second side brush motors 351, 352 can be configured such that the primary side brush 338 and the secondary side brush 348 rotate at the same or different speeds. In some instances, the rotational speed and/or direction of the primary and/or secondary side brush 338, 348 may be adjusted based on a detected floor type.

Figure 6:
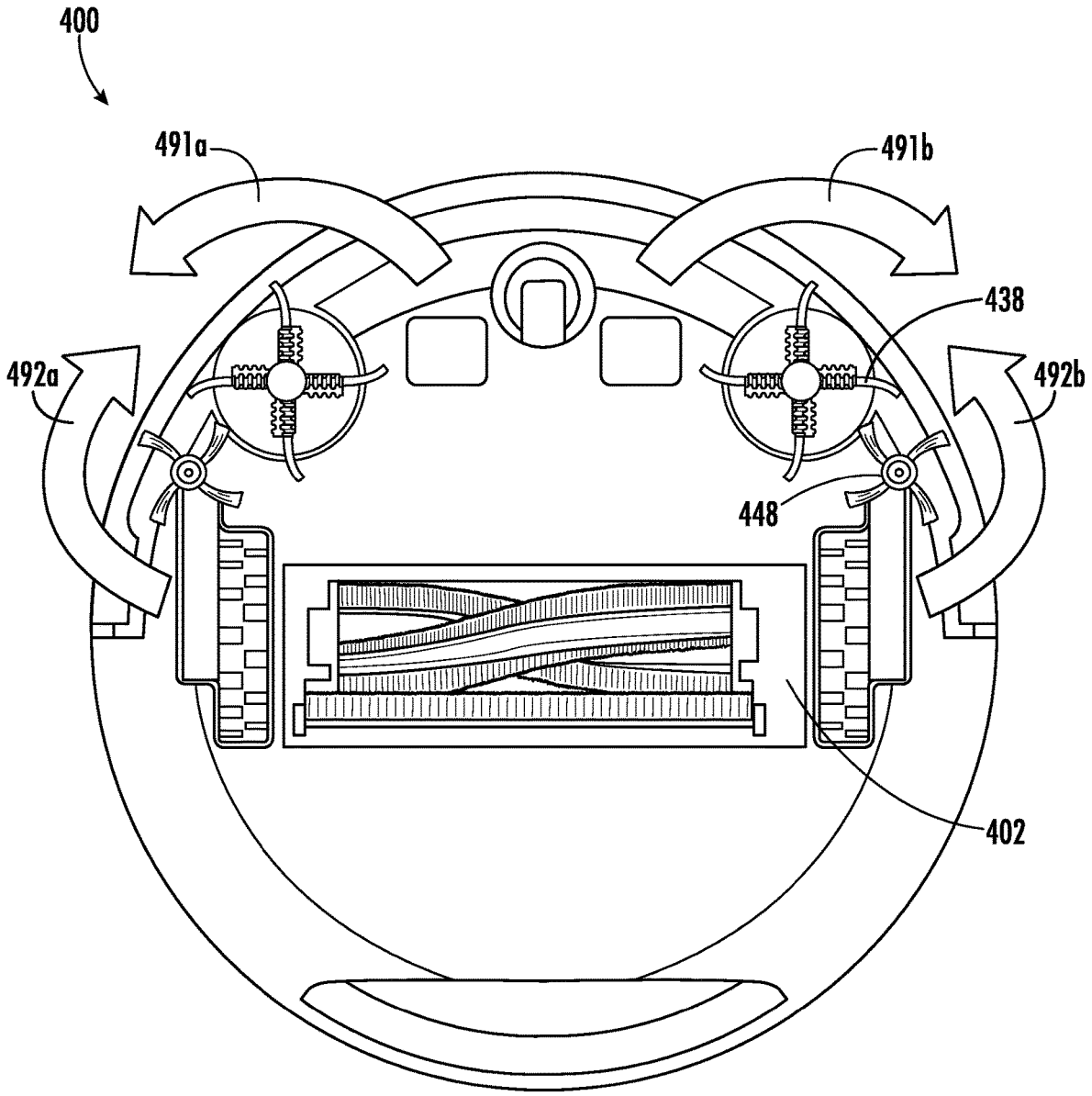
FIG. 6 is a schematic view of an example of a robotic vacuum cleaner, consistent with embodiments of the present disclosure.

FIG. 6 shows an example of a robotic vacuum cleaner 400, which may be an example of the robotic cleaner 100 of FIG. 1. As shown, the robotic vacuum cleaner 400 includes a first and second brush group, wherein each brush group includes at least one primary side brush 438 and at least one secondary side brush 448. In other words, the first brush group may include at least a first primary side brush 438 and a first secondary side brush 448 and the second brush group may include at least a second primary side brush 438 and a second secondary side brush 448. The first brush group and the second brush group may be on opposing sides of the robotic vacuum cleaner 400. The side brushes 438, 448 within each brush group may be configured to urge debris towards an air inlet 402.

As shown, immediately adjacent side brushes 438, 448 within a respective brush group may be counter rotating. For example, immediately adjacent side brushes 438, 448 within a respective brush group may rotate towards each other. Such a configuration may urge debris towards the air inlet 402. In some instances, immediately adjacent side brushes 438, 448 within a respective brush group may be corotating.

As also shown, corresponding side brushes 438, 448 from brush groups on opposing sides of the robotic vacuum cleaner 400 may also be counter rotating. For example, the primary side brush 438 of the first brush group and the primary side brush 438 of the second brush group can be counter rotating and the secondary side brush 448 of the first brush group and the secondary side brush 448 of the second brush group can be counter rotating. In other words, the primary side brush 438 of the first brush group may have a first primary rotation direction 491*a*, the secondary side brush 448 of the first brush group may have a first secondary rotation direction 492*a*, the primary brush 438 of the second brush group may have a second primary rotation direction 491*b*, and the secondary side brush 448 of the second brush group may have a second secondary rotation direction 492*b*, wherein the first primary rotation direction 491*a* is opposite the second primary rotation direction 491*b* and the first secondary rotation direction 492*a* is opposite the second secondary rotation direction 492*b*. In some instances, the first and second primary rotation directions 491*a*, 491*b* and the first and second secondary rotation directions 492*a*, 492*b* may be based, at least in part, on a location of the side brushes 438, 448.

Figure 7A:
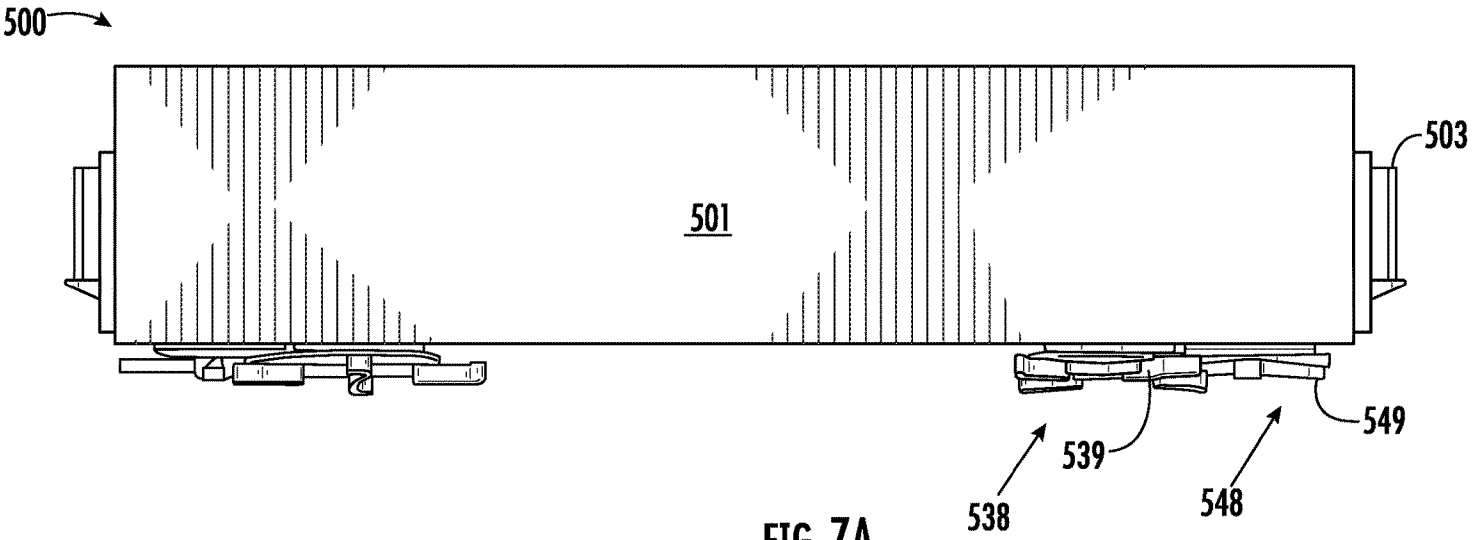
FIG. 7A is a schematic front view of an example of a robotic vacuum cleaner having portions of the robotic cleaner removed therefrom for purposes of clarity, consistent with embodiments of the present disclosure.
Figure 7B:
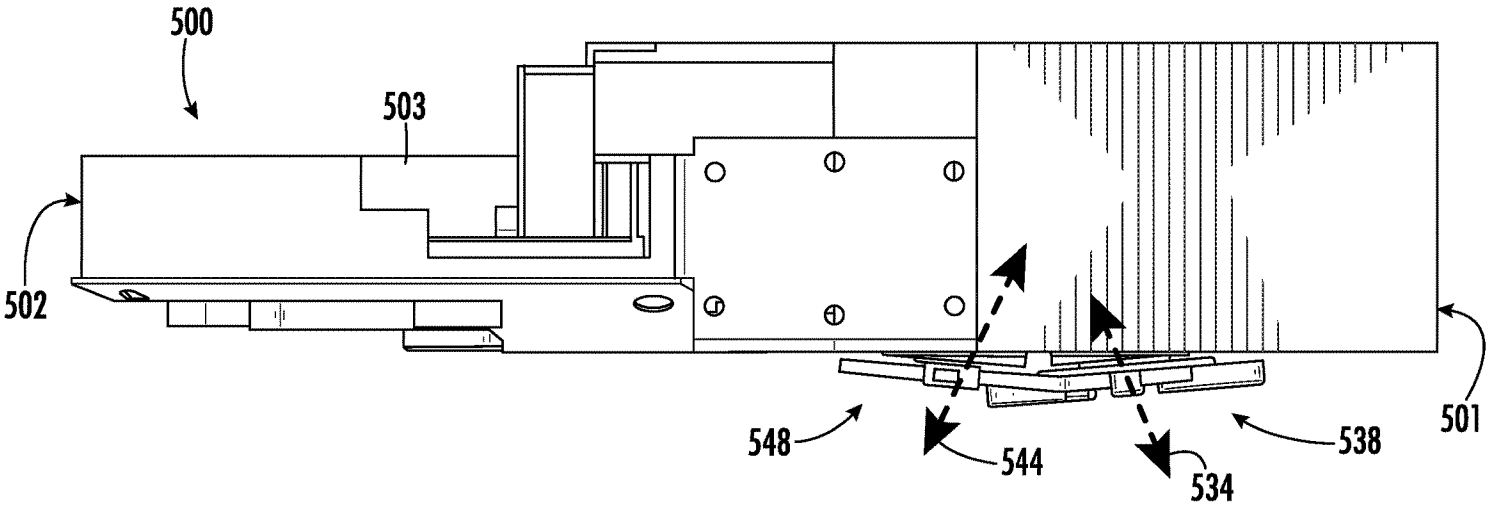
FIG. 7B is a schematic side view of the robotic vacuum cleaner of FIG. 7A, consistent with embodiments of the present disclosure.
Figure 7C:
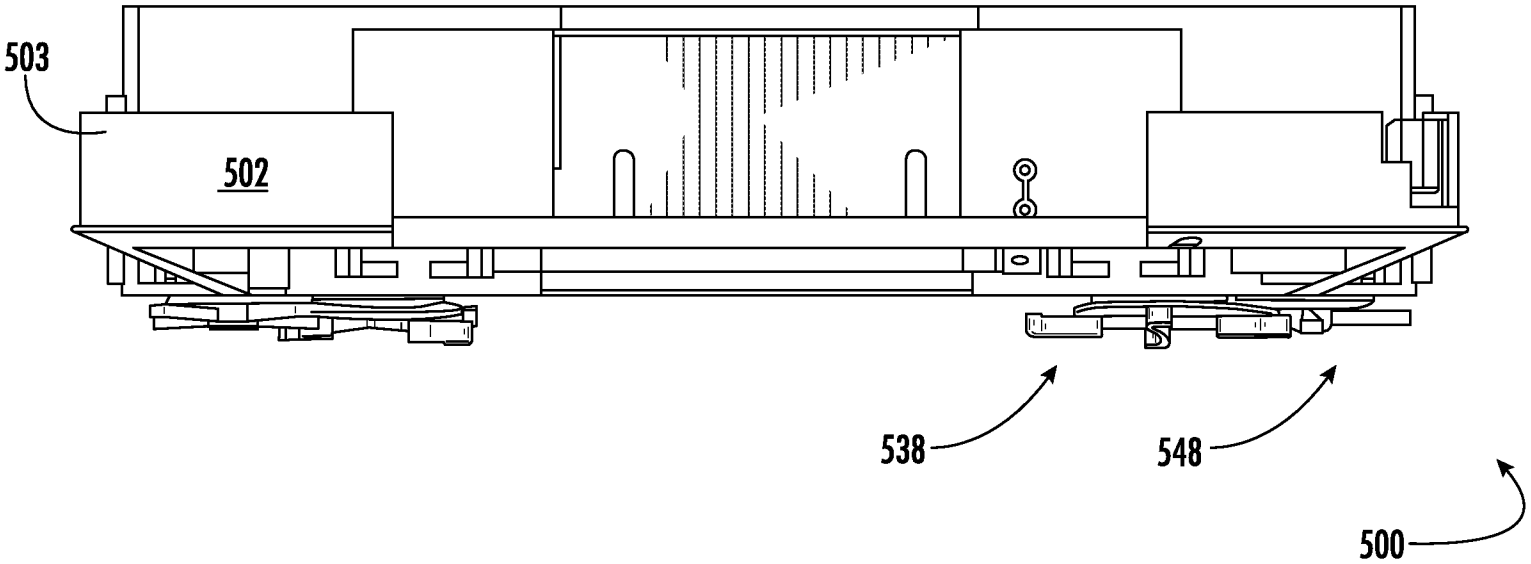
FIG. 7C is a schematic back view of the robotic vacuum cleaner of FIG. 7A, consistent with embodiments of the present disclosure.

FIGS. 7A-7C show a portion of a robotic vacuum cleaner 500, which may be an example of the robotic cleaner 100 of FIG. 1. As shown, the robotic vacuum cleaner 500 includes a chassis 503 having a front side 501 and a back side 502, a primary side brush 538, and a secondary side brush 548. The primary side brush 538 and the secondary side brush 548 can be configured to cooperate to urge debris towards an air inlet of the robotic vacuum cleaner 500. The primary side brush 538 is disposed between the front side 501 of the chassis 503 and at least a portion of the secondary side brush 548. As such, the primary side brush 538 may generally be described as being positioned forward of the secondary side brush 548. The primary side brush 538 and the secondary side brush 548 each include at least one side brush arm 539, 549.

The primary side brush 538 is configured to rotate about a primary side brush rotation axis 534 and the secondary side brush 548 is configured to rotate about a secondary side brush rotation axis 544. Each of the primary side brush 538 and the secondary side brush 548 define a swept area that extends around the primary side brush rotation axis 534 and the secondary side brush rotation axis 544, respectively. In some instances, the swept area may not extend beyond a perimeter of the housing. As described above in FIG. 6, the primary side brush 538 and the secondary side brush 548 can be counter-rotating.

The side brushes 538, 548 can be configured to engage a surface to be cleaned for only a portion of the swept area. For example, the side brushes 538, 548 may not maintain consistent contact with the surface to be cleaned when rotating through the swept area. In other words, at least a portion of one or more of the side brushes 538, 548 may come out of engagement with the surface to be cleaned one or more times when rotating through the swept area.

As shown, one or more of the primary side brush rotation axis 534 and/or the secondary side brush rotation axis 544 can extend in a non-vertical direction. In other words, one or more of the primary side brush rotation axis 534 and/or the secondary side brush rotation axis 544 may extend transverse to a surface to be cleaned at a non-perpendicular angle. In some instances, both of the rotation axes 534, 544 may be angled such that the rotation axes 534, 544 converge (e.g., with or without intersecting) with increasing distance from the surface to be cleaned. Alternatively, both of the rotation axes 534, 544 may be angled such that the rotation axes 534, 544 diverge with increasing distance from the surface to be cleaned. In some instances, the primary side brush rotation axis 534 and/or the secondary side brush rotation axis 544 can be angled such that the rotation axes 534 and 544 intersect.

By way of further example, the primary side brush rotation axis 534 can be angled such that, as the primary side brush rotation axis 534 extends away from a surface to be cleaned, the primary side brush rotation axis 534 extends towards the back side 502 of the chassis 503 of the robotic vacuum cleaner 500. In this configuration, the side brush arm 539 of the primary side brush 538 may engage the surface to be cleaned when moving from a periphery of the chassis 503 and towards an air inlet of the robotic vacuum cleaner 500. Such a configuration may result in the side brush arm 539 coming into engagement (e.g., contact) with the surface to be cleaned at a location when the engagement causes debris to be urged towards the air inlet of the robotic vacuum cleaner 500. In this example, the secondary side brush rotation axis 544 can be angled such that, as the secondary side brush rotation axis 544 extends away from a surface to be cleaned, the secondary side brush rotation axis 544 extends towards the front side 501 of the chassis 503 of the robotic vacuum cleaner 500. In this configuration, the side brush arm 549 of the secondary side brush 548 may engage the surface to be cleaned when moving from a periphery of the chassis 503 and towards the air inlet of the robotic vacuum cleaner 500. Such a configuration may result in the side brush arm 549 coming into engagement (e.g., contact) with the surface to be cleaned at a location when the engagement causes debris to be urged towards the air inlet of the robotic vacuum cleaner 500.

Angling the rotation axes 534, 544 causes the swept area of each side brush 538, 548 to extend within a plane that extends transverse to the surface to be cleaned. As a result, there may be inconsistent engagement between the side brushes 538, 548 and the surface to be cleaned when the side brushes 538, 548 are rotated. The rotation axes 534, 544 can be angled such that the side brushes 538, 548 engage the surface to be cleaned in the portion (or portions) of the swept area that results in debris on the surface being cleaned being urged in a direction of an air inlet of the robotic vacuum cleaner 500. For example, the rotation axes 534, 544 can be angled such that the side brushes 538, 548 only engage the surface to be cleaned when rotating in a direction towards the air inlet of the robotic vacuum cleaner 500.

The primary side brush axis 534 may form an angle with a vertical axis that measures in a range of 5° to 30°. The secondary brush axis 544 form an angle with a vertical axis that measures in a range of 5° to 30°.

While FIGS. 7A-7C shows both rotation axes 534, 544 as being angled relative to a vertical axis, other configurations are possible. For example, only one of the rotation axes 534, 544 may be angled relative to a vertical axis.

An example of a robotic cleaner, consistent with the present disclosure, may include an air inlet, a suction motor, the suction motor being fluidly coupled to the air inlet, and a first primary side brush configured to rotate about a first primary side brush rotation axis. The first primary side brush rotation axis may extend transverse to a surface to be cleaned at a first non-perpendicular angle.

In some instances, the robotic cleaner may further include a first secondary side brush configured to rotate about a first secondary side brush rotation axis. In some instances, the first secondary side brush rotation axis may extend transverse to the surface to be cleaned at a second non-perpendicular angle. In some instances, the first primary side brush rotation axis and the first secondary side brush rotation axis may converge with increasing distance from the surface to be cleaned. In some instances, the first primary side brush rotation axis and the first secondary side brush rotation axis may diverge with increasing distance from the surface to be cleaned. In some instances, the first primary side brush and the first secondary side brush may be configured to be counter rotating. In some instances, the first primary side brush and the first secondary side brush may be configured to urge debris towards the air inlet. In some instances, the robotic cleaner may further include a second primary side brush and a second secondary side brush, the first primary side brush and the first secondary side brush being associated with a first brush group and the second primary side brush and the second secondary side brush being associated with a second brush group. In some instances, the first brush group and the second brush group may be disposed on opposing sides of a central axis of the robotic cleaner, the central axis extending parallel to a direction of forward movement of the robotic cleaner. In some instances, the first primary side brush and the second primary side brush may be counter rotating and the first secondary side brush and the second secondary side brush may be counter rotating.

Another example of a robotic cleaner, consistent with the present disclosure, may include an air inlet, a suction motor, the suction motor being fluidly coupled to the air inlet, a first primary side brush and a first secondary side brush. The first primary side brush may be configured to rotate about a first primary side brush rotation axis and the first primary side brush rotation axis may extend transverse to a surface to be cleaned at a first non-perpendicular angle. The first secondary side brush may be configured to rotate about a first secondary side brush rotation axis. The first primary side brush may define a first primary side brush swept area and the first secondary side brush may define a first secondary side brush swept area. The first primary side brush swept area may at least partially overlap the first secondary side brush swept area.

In some instances, the first primary side brush and the first secondary side brush may be driven by a common side brush motor. In some instances, the first secondary side brush rotation axis may extend transverse to the surface to be cleaned at a second non-perpendicular angle. In some instances, the first primary side brush rotation axis and the first secondary side brush rotation axis may converge with increasing distance from the surface to be cleaned. In some instances, the first primary side brush rotation axis and the first secondary side brush rotation axis may diverge with increasing distance from the surface to be cleaned. In some instances, the first primary side brush and the first secondary side brush may be configured to be counter rotating. In some instances, the first primary side brush and the first secondary side brush may be configured to urge debris towards the air inlet. In some instances, the robotic cleaner may further include a second primary side brush and a second secondary side brush, the first primary side brush and the first secondary side brush being associated with a first brush group and the second primary side brush and the second secondary side brush being associated with a second brush group. In some instances, the first brush group and the second brush group may be disposed on opposing sides of a central axis of the robotic cleaner, the central axis extending parallel to a direction of forward movement of the robotic cleaner. In some instances, the first primary side brush and the second primary side brush may be counter rotating and the first secondary side brush and the second secondary side brush may be counter rotating.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A robotic cleaner comprising:

an air inlet;

a suction motor, the suction motor being fluidly coupled to the air inlet;

a first primary side brush configured to rotate about a first primary side brush rotation axis, the first primary side brush rotation axis extending transverse to a surface to be cleaned at a first non-perpendicular angle; and a first secondary side brush configured to rotate about a first secondary side brush rotation axis, wherein:

the first primary side brush includes a hub, a protrusion extending from the hub, and a blade extending from the protrusion, the blade configured to engage the surface to be cleaned; and the first secondary side brush includes a plurality of bristles configured to engage the surface to be cleaned.

2. The robotic cleaner of claim 1, wherein the first secondary side brush rotation axis extends transverse to the surface to be cleaned at a second non-perpendicular angle.

3. The robotic cleaner of claim 2, wherein the first primary side brush rotation axis and the first secondary side brush rotation axis converge with increasing distance from the surface to be cleaned.

4. The robotic cleaner of claim 2, wherein the first primary side brush rotation axis and the first secondary side brush rotation axis diverge with increasing distance from the surface to be cleaned.

5. The robotic cleaner of claim 1, wherein the first primary side brush and the first secondary side brush are configured to be counter rotating.

6. The robotic cleaner of claim 1, wherein the first primary side brush and the first secondary side brush are configured to urge debris towards the air inlet.

7. The robotic cleaner of claim 1 further comprising a second primary side brush and a second secondary side brush, the first primary side brush and the first secondary side brush being associated with a first brush group and the second primary side brush and the second secondary side brush being associated with a second brush group.

8. The robotic cleaner of claim 7, wherein the first brush group and the second brush group are disposed on opposing sides of a central axis of the robotic cleaner, the central axis extending parallel to a direction of forward movement of the robotic cleaner.

9. The robotic cleaner of claim 7, wherein the first primary side brush and the second primary side brush are counter rotating and the first secondary side brush and the second secondary side brush are counter rotating.

10. A robotic cleaner comprising:

an air inlet;

a suction motor, the suction motor being fluidly coupled to the air inlet;

a first primary side brush configured to rotate about a first primary side brush rotation axis, the first primary side brush rotation axis extending transverse to a surface to be cleaned at a first non-perpendicular angle; and a first secondary side brush configured to rotate about a first secondary side brush rotation axis, the first primary side brush defining a first primary side brush swept area and the first secondary side brush defining a first secondary side brush swept area, the first primary side brush swept area at least partially overlapping the first secondary side brush swept area, wherein:

the first primary side brush includes a hub, a protrusion extending from the hub, and a blade extending from the protrusion, the blade configured to engage the surface to be cleaned; and the first secondary side brush includes a plurality of bristles configured to engage the surface to be cleaned.

11. The robotic cleaner of claim 10, wherein the first primary side brush and the first secondary side brush are driven by a common side brush motor.

12. The robotic cleaner of claim 10, wherein the first secondary side brush rotation axis extends transverse to the surface to be cleaned at a second non-perpendicular angle.

13. The robotic cleaner of claim 12, wherein the first primary side brush rotation axis and the first secondary side brush rotation axis converge with increasing distance from the surface to be cleaned.

14. The robotic cleaner of claim 12, wherein the first primary side brush rotation axis and the first secondary side brush rotation axis diverge with increasing distance from the surface to be cleaned.

15. The robotic cleaner of claim 10, wherein the first primary side brush and the first secondary side brush are configured to be counter rotating.

16. The robotic cleaner of claim 10, wherein the first primary side brush and the first secondary side brush are configured to urge debris towards the air inlet.

17. The robotic cleaner of claim 10 further comprising a second primary side brush and a second secondary side brush, the first primary side brush and the first secondary side brush being associated with a first brush group and the second primary side brush and the second secondary side brush being associated with a second brush group.

18. The robotic cleaner of claim 17, wherein the first brush group and the second brush group are disposed on opposing sides of a central axis of the robotic cleaner, the central axis extending parallel to a direction of forward movement of the robotic cleaner.

19. The robotic cleaner of claim 17, wherein the first primary side brush and the second primary side brush are counter rotating and the first secondary side brush and the second secondary side brush are counter rotating.

20. The robotic cleaner of claim 1, wherein a rigidity of the blade is greater than a rigidity of the protrusion and the blade has an arcuate shape that is configured to urge debris towards the air inlet.

* * * * *